US011128032B2

(12) United States Patent
Da Costa Bras Lima et al.

(10) Patent No.: US 11,128,032 B2
(45) Date of Patent: Sep. 21, 2021

(54) ELECTRONIC DEVICES HAVING MULTI-BAND ANTENNAS

(71) Applicant: Apple Inc., Cupertino, CA (US)

(72) Inventors: Eduardo Jorge Da Costa Bras Lima, Sunnyvale, CA (US); Andrea Ruaro, Campbell, CA (US); Carlo Di Nallo, Belmont, CA (US); Dimitrios Papantonis, Cupertino, CA (US); Jayesh Nath, Milpitas, CA (US); Jiaxiao Niu, Shanghai (CN); Johan Avendal, Cupertino, CA (US); Mattia Pascolini, San Francisco, CA (US); Max O. Landaeus, Cupertino, CA (US); Ryan C. Perkins, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 96 days.

(21) Appl. No.: 16/537,220

(22) Filed: Aug. 9, 2019

(65) Prior Publication Data

US 2021/0043999 A1 Feb. 11, 2021

(51) Int. Cl.

| | |
|---|---|
| ***H01Q 1/24*** | (2006.01) |
| ***H01Q 1/22*** | (2006.01) |
| ***H01Q 5/25*** | (2015.01) |
| ***H01Q 9/42*** | (2006.01) |
| ***H01Q 5/30*** | (2015.01) |

(52) U.S. Cl.

CPC ..... *H01Q 1/2291* (2013.01); *H01Q 1/24* (2013.01); *H01Q 5/25* (2015.01); *H01Q 5/30* (2015.01); *H01Q 9/42* (2013.01)

(58) Field of Classification Search

CPC ..... H01Q 1/48; H01Q 1/241; H01Q 1/243; H01Q 1/273; H01Q 5/371; H01Q 9/42; H01Q 21/28

See application file for complete search history.

(56) References Cited

U.S. PATENT DOCUMENTS

| | | | | |
|---|---|---|---|---|
| 6,529,749 | B1 * | 3/2003 | Hayes | H01Q 1/243 343/702 |
| 8,294,621 | B2 | 10/2012 | Tran | |
| 9,118,109 | B2 | 8/2015 | Oh et al. | |
| 9,496,600 | B2 | 11/2016 | Irci et al. | |
| 9,865,915 | B2 | 1/2018 | Shiu et al. | |

(Continued)

*Primary Examiner* — Tung X Le

(74) *Attorney, Agent, or Firm* — Treyz Law Group, P.C.; Michael H. Lyons

(57) ABSTRACT

An electronic device may be provided with a housing, a logic board, and wireless circuitry on the logic board. The wireless circuitry may include first and second antennas formed from conductive traces on a surface of the logic board. The first and second antennas may include resonating element arms at opposing sides of the logic board. The first antenna may have a fundamental mode that radiates in a Bluetooth® communications band at 2.4 GHz. The second antenna may radiate in a first ultra-wideband communications band such as a 6.5 GHz ultra-wideband communications band. If desired, the second antenna may also radiate in a second ultra-wideband communications band such as an 8.0 GHz ultra-wideband communications band. In another suitable arrangement, a harmonic mode of the first antenna may radiate in the second ultra-wideband communications band.

20 Claims, 8 Drawing Sheets

(56) References Cited

U.S. PATENT DOCUMENTS

| | | | | |
|---|---|---|---|---|
| 2015/0022417 | A1* | 1/2015 | Pan | H01Q 9/40 343/843 |
| 2015/0364820 | A1* | 12/2015 | Dong | H01Q 5/371 343/729 |
| 2016/0285166 | A1* | 9/2016 | Andujar Linares | H01Q 5/335 |
| 2017/0170562 | A1* | 6/2017 | Lee | H01Q 9/14 |
| 2018/0294547 | A1 | 10/2018 | Park et al. | |
| 2019/0157745 | A1* | 5/2019 | Ha | H04M 1/0274 |
| 2019/0363428 | A1* | 11/2019 | Zhu | H01Q 9/0457 |

* cited by examiner

ELECTRONIC DEVICES HAVING MULTI-BAND ANTENNAS

BACKGROUND

This relates to electronic devices and, more particularly, to electronic devices with wireless communications circuitry.

Electronic devices often include wireless communications circuitry. For example, cellular telephones, computers, and other devices often contain antennas and wireless transceivers for supporting wireless communications. Some electronic devices perform location detection operations to detect the location of an external device based on an angle of arrival of signals received from the external device (using multiple antennas).

To satisfy consumer demand for small form factor wireless devices, manufacturers are continually striving to implement wireless communications circuitry such as antenna components for performing location detection operations using compact structures. At the same time, there is a desire for wireless devices to cover a growing number of frequency bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over the desired range of operating frequencies.

It would therefore be desirable to be able to provide improved wireless communications circuitry for wireless electronic devices.

SUMMARY

An electronic device may be provided with a housing, a logic board in the housing, and wireless circuitry on the logic board. The wireless circuitry may include first and second antennas. The first antenna may have a first resonating element arm formed from first conductive traces on a surface of the logic board. The second antenna may have a second resonating element arm formed from second conductive traces on the surface of the logic board. Ground traces for the first and second antennas may be patterned on the surface of the logic board.

The first and second resonating element arms may be coupled to the ground traces by respective first and second return paths. The first and second resonating element arms may be located at opposing sides of the ground traces. The first resonating element arm may have a tip facing the return path for the second resonating element arm. The second resonating element arm may have a tip facing the return path for the first resonating element arm. The housing may have a rear wall, a front wall, and a cylindrical sidewall extending from the rear wall to the front wall. The logic board may have an outline that conforms to the shape of the cylindrical sidewall. The first and second resonating elements may be curved about a central axis of the electronic device.

The first antenna may have a fundamental mode that radiates in a non-ultra-wideband communications band such as the Bluetooth® communications band at 2.4 GHz. The second antenna may radiate in a first ultra-wideband communications band such as a 6.5 GHz ultra-wideband communications band. If desired, the second antenna may also radiate in a second ultra-wideband communications band such as an 8.0 GHz ultra-wideband communications band.

In another suitable arrangement, a harmonic mode of the first antenna may radiate in the second ultra-wideband communications band.

DETAILED DESCRIPTION

Figure 1:
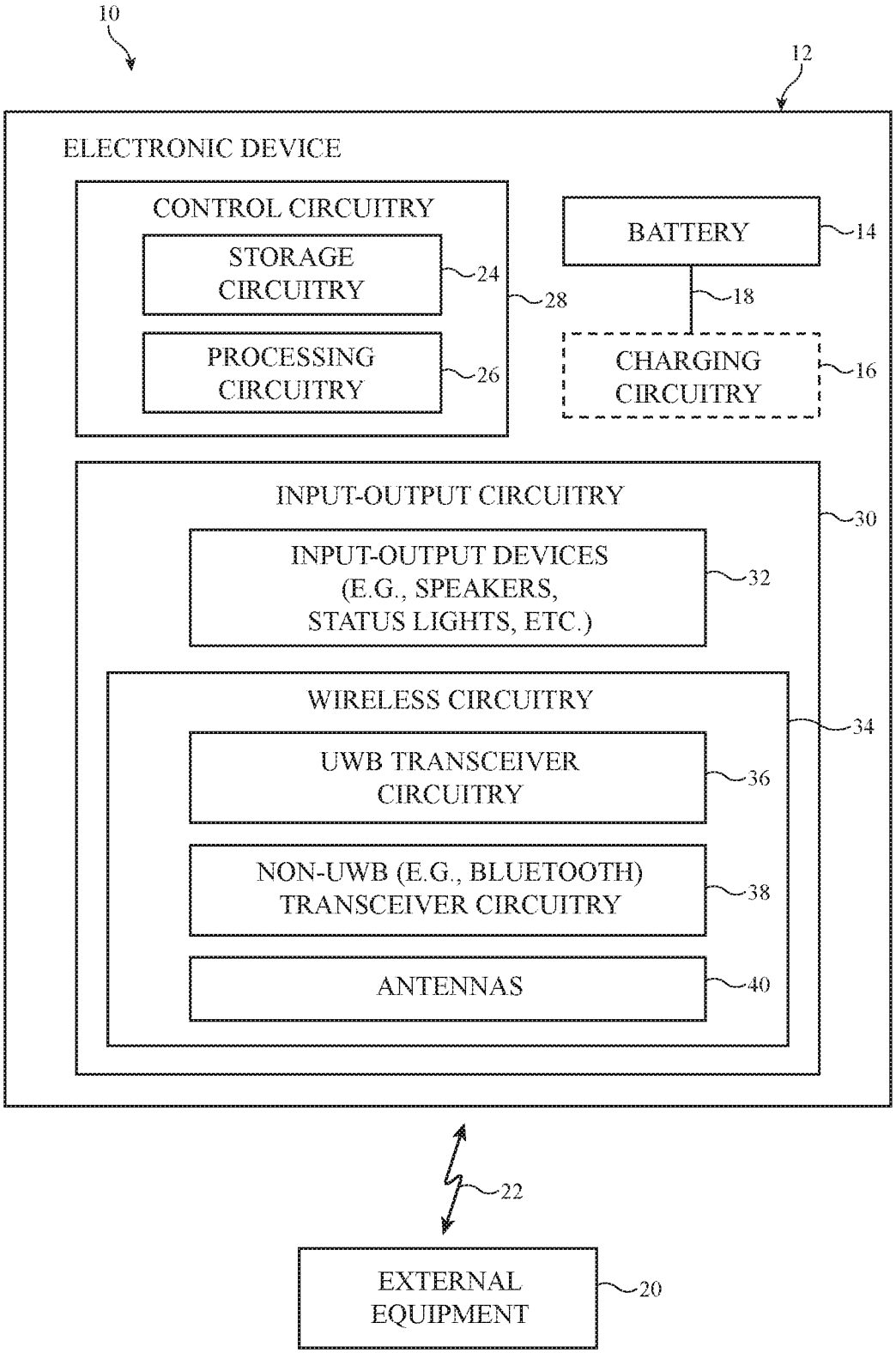
FIG. 1 is a schematic diagram of illustrative circuitry in an electronic device that is configured to wirelessly communicate with external equipment in accordance with some embodiments.

Electronic devices such as electronic device 10 of FIG. 1 may be provided with wireless circuitry (sometimes referred to herein as wireless communications circuitry). The wireless circuitry may be used to support wireless communications in multiple wireless communications bands. Communications bands (sometimes referred to herein as frequency bands) handled by the wireless circuitry can include satellite navigation system communications bands, cellular telephone communications bands, wireless local area network communications bands, near-field communications bands, ultra-wideband communications bands, or other wireless communications bands.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, wireless tag device, wireless tracking device (e.g., a tracking tag), or other miniature or wearable device, a larger handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

As shown in the schematic diagram FIG. 1, device 10 may include components located on or within an electronic device housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts or all of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may include control circuitry 28. Control circuitry 28 may include storage such as storage circuitry 24 and processing circuitry such as processing circuitry 26. Storage circuitry 24 may include hard disk drive storage, nonvolatile memory (e.g., flash memory or other electrically-programmable-read-only memory configured to form a solid-state drive), volatile memory (e.g., static or dynamic random-access-memory), etc. Processing circuitry 26 may be used to control the operation of device 10. Processing circuitry 26 may include one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 24 (e.g., storage circuitry 24 may include non-transitory (tangible) computer readable storage media that stores the software code). The software code may sometimes be referred to as program instructions, software, data, instructions, or code. Software code stored on storage circuitry 24 may be executed by processing circuitry 26.

Control circuitry 28 may be used to run software on device 10 such as external node location applications, satellite navigation applications, internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as Wi-Fi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), IEEE 802.15.4 ultra-wideband communications protocols or other ultra-wideband communications protocols, etc. Each communications protocol may be associated with a corresponding radio access technology (RAT) that specifies the physical connection methodology used in implementing the protocol.

Device 10 may be powered using a battery such as battery 14. In one suitable arrangement, battery 14 is a removable battery that can be removed and replaced by a user upon depletion of charge on battery 14 (e.g., housing 12 may include a port or opening through which a user can access battery 14 for replacement). In another suitable arrangement, battery 14 may be a rechargeable. In this scenario, device 10 may include optional charging circuitry 16 that charges battery 14 over path 18. Optional charging circuitry 16 may receive power from an alternating-current power source such as a wired power source (e.g., a wall outlet or other wired power source) or may receive wireless power over the air (e.g., using a near-field charging element such as an inductive coil) and may use this power to charge battery 14 or to otherwise power the components of device 10. Charging circuitry 16 and path 18 may be omitted in scenarios where battery 14 is replaced upon depletion of charge.

Device 10 may include input-output circuitry 30. Input-output circuitry 30 may include input-output devices 32. Input-output devices 32 may be used to allow data to be supplied to device 10 and to allow data to be provided from device 10 to external devices. Input-output devices 32 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

In one suitable arrangement that is sometimes described herein as an example, device 10 may be formed without any display (e.g., without an LCD display, touch screen display, any other type of display having display pixel circuitry, etc.) to minimize the manufacturing cost and complexity for device 10. This may also allow device 10 to exhibit a relatively small size while consuming relatively little power (e.g., device 10 may be only a few centimeters or less in diameter). In this scenario, input-output devices 32 may include one or more speakers, one or more buttons, and/or one or more status indicator lights. However, these components may be omitted if desired.

Input-output circuitry 30 may include wireless circuitry such as wireless circuitry 34 (sometimes referred to herein as wireless communications circuitry 34) for wirelessly conveying radio-frequency signals 22 to and/or from external equipment 20. External equipment 20 may be a laptop computer, a tablet computer, a somewhat smaller device such as a wrist-watch device, pendant device, headphone device, earpiece device, wireless tag device, wireless tracking device (e.g., a tracking tag), or other miniature or wearable device, a larger handheld device such as a cellular telephone, a media player, or other small portable device, a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment. To support wireless communications, wireless circuitry 34 may include radio-frequency (RF) transceiver circuitry formed from one or more integrated circuits, power amplifier circuitry, low-noise input amplifiers, passive RF components, one or more antennas such as antennas 40, transmission lines, and other circuitry for handling RF wireless signals. Wireless signals can also be sent using light (e.g., using infrared communications).

While control circuitry 28 is shown separately from wireless circuitry 34 in the example of FIG. 1 for the sake of clarity, wireless circuitry 34 may include processing circuitry that forms a part of processing circuitry 26 and/or storage circuitry that forms a part of storage circuitry 24 of control circuitry 28 (e.g., portions of control circuitry 28 may be implemented on wireless circuitry 34). As an example, control circuitry 28 (e.g., processing circuitry 26) may include baseband processor circuitry or other control components that form a part of wireless circuitry 34.

Wireless circuitry 34 may include radio-frequency transceiver circuitry for handling various radio-frequency communications bands. For example, wireless circuitry 34 may include ultra-wideband (UWB) transceiver circuitry 36 that supports communications using the IEEE 802.15.4 protocol and/or other ultra-wideband communications protocols.

Ultra-wideband radio-frequency signals may be based on an impulse radio signaling scheme that uses band-limited data pulses. Ultra-wideband signals may have any desired bandwidths such as bandwidths between 499 MHz and 1331 MHz, bandwidths greater than 500 MHz, etc. The presence of lower frequencies in the baseband may sometimes allow ultra-wideband signals to penetrate through objects such as walls. In an IEEE 802.15.4 system, a pair of electronic devices may exchange wireless time stamped messages. Time stamps in the messages may be analyzed to determine the time of flight of the messages and thereby determine the distance (range) between the devices and/or an angle between the devices (e.g., an angle of arrival of incoming radio-frequency signals). Ultra-wideband transceiver circuitry 36 may operate (convey radio-frequency signals) in communications bands such as one or more ultra-wideband communications bands between about 5 GHz and about 8.3 GHz (e.g., a 6.5 GHz UWB communications band, an 8 GHz UWB communications band, and/or bands at other suitable frequencies).

As shown in FIG. 1, wireless circuitry 34 may also include non-UWB transceiver circuitry 38. Non-UWB transceiver circuitry 38 may handle communications bands other than UWB communications bands such as 2.4 GHz and 5 GHz bands for Wi-Fi® (IEEE 802.11) communications or communications in other wireless local area network (WLAN) bands, the 2.4 GHz Bluetooth® communications band or other wireless personal area network (WPAN) bands, and/or cellular telephone frequency bands such as a cellular low band (LB) from 600 to 960 MHz, a cellular low-midband (LMB) from 1410 to 1510 MHz, a cellular midband (MB) from 1710 to 2170 MHz, a cellular high band (HB) from 2300 to 2700 MHz, a cellular ultra-high band (UHB) from 3300 to 5000 MHz, or other communications bands between 600 MHz and 5000 MHz or other suitable frequencies (as examples).

Non-UWB transceiver circuitry 38 may handle voice data and non-voice data. Wireless circuitry 34 may include circuitry for other short-range and long-range wireless links if desired. For example, wireless circuitry 34 may include 60 GHz transceiver circuitry (e.g., millimeter wave transceiver circuitry), circuitry for receiving television and radio signals, paging system transceivers, near field communications (NFC) circuitry, etc.

In one suitable arrangement that is sometimes described herein as an example, non-UWB transceiver 38 only includes a radio-frequency transceiver for covering the 2.4 GHz Bluetooth® communications band, other wireless personal area network (WPAN) bands, or a WLAN band at 2.4 GHz. This may serve to minimize space consumption by wireless circuitry 34 within device 10, thereby allowing device 10 to be further reduced in size relative to scenarios where additional transceivers are used. Device 10 may use radio-frequency signals in the 2.4 GHz Bluetooth® communications band to convey data to and/or from external equipment 20. At the same time, UWB transceiver circuitry 36 may convey radio-frequency signals in one or more UWB communications bands to allow external equipment 20 to perform range detection and angle-of-arrival detection operations on device 10 (e.g., so that external equipment 20 may identify the location of device 10 relative to external equipment 20). In other words, radio-frequency signals 22 of FIG. 1 may include radio-frequency signals in the Bluetooth® communications band and radio-frequency signals in one or more UWB communications bands that are conveyed by wireless circuitry 34.

Wireless circuitry 34 may include antennas 40. Antennas 40 may be formed using any suitable types of antenna structures. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of two or more of these designs, etc. If desired, one or more of antennas 40 may be cavity-backed antennas.

Different types of antennas may be used for different bands and combinations of bands. For example, one type of antenna may be used in forming a local wireless link antenna and another type of antenna may be used in forming a remote wireless link antenna. Dedicated antennas may be used for conveying radio-frequency signals in a UWB communications band or, if desired, antennas 40 can be configured to convey both radio-frequency signals in a UWB communications band and radio-frequency signals in a non-UWB communications band (e.g., the Bluetooth® communications band).

Space is often at a premium in electronic devices such as device 10. In order to further minimize space consumption within device 10, the same antenna 40 may be used to cover multiple communications (frequency) bands. In one suitable arrangement that is described herein as an example, antennas 40 may include a first and second antennas. The first antenna may convey radio-frequency signals in a first communications band whereas the second antenna conveys radio-frequency signals in second and third communications bands. Examples of communications bands that may be used as the first, second, and third communications bands include the 2.4 GHz Bluetooth® frequency band, the 6.5 GHz UWB communications band (e.g., including frequencies from 6250 MHz to 6750 MHz), and the 8.0 GHz UWB communications band (e.g., including frequencies from 7750 to 8250 MHz). This is merely illustrative. Any desired UWB communications bands may be used. Radio-frequency signals that are conveyed in UWB communications bands (e.g., using a UWB protocol) may sometimes be referred to herein as UWB signals or UWB radio-frequency signals. Radio-frequency signals in frequency bands other than the UWB communications bands (e.g., radio-frequency signals in cellular telephone frequency bands, WPAN frequency bands, WLAN frequency bands, etc.) may sometimes be referred to herein as non-UWB signals or non-UWB radio-frequency signals.

Figure 2:
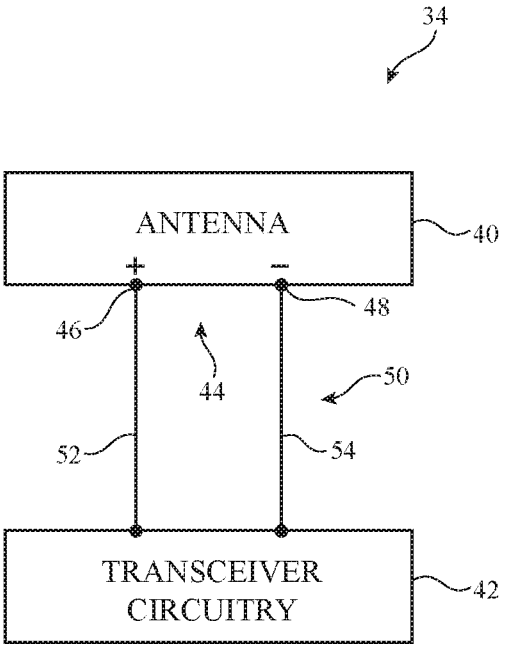
FIG. 2 is a schematic diagram of illustrative wireless circuitry in accordance with some embodiments.

A schematic diagram of wireless circuitry 34 is shown in FIG. 2. As shown in FIG. 2, wireless circuitry 34 may include transceiver circuitry 42 (e.g., UWB transceiver circuitry 36 or non-UWB transceiver circuitry 38 of FIG. 1) that is coupled to a given antenna 40 using a radio-frequency transmission line path such as radio-frequency transmission line path 50.

To provide antenna structures such as antenna 40 with the ability to cover different frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components that tune the antenna over communications (frequency) bands of interest. The tunable components may be part of a tunable filter or tunable impedance matching network, may be part of an antenna resonating element, may span a gap between an antenna resonating element and antenna ground, etc. If desired, antenna 40 may be formed without active tuning or switching circuitry to minimize manufacturing cost and complexity as well as space consumption within device 10.

Radio-frequency transmission line path 50 may include one or more radio-frequency transmission lines (sometimes referred to herein simply as transmission lines). Radio-frequency transmission line path 50 (e.g., the transmission lines in radio-frequency transmission line path 50) may include a positive signal conductor such as positive signal conductor 52 and a ground signal conductor such as ground conductor 54.

The transmission lines in radio-frequency transmission line path 50 may, for example, include coaxial cable transmission lines (e.g., ground conductor 54 may be implemented as a grounded conductive braid surrounding signal conductor 52 along its length), stripline transmission lines (e.g., where ground conductor 54 extends along two sides of signal conductor 52), a microstrip transmission line (e.g., where ground conductor 54 extends along one side of signal conductor 52), coaxial probes realized by a metalized via, edge-coupled microstrip transmission lines, edge-coupled stripline transmission lines, waveguide structures (e.g., coplanar waveguides or grounded coplanar waveguides), combinations of these types of transmission lines and/or other transmission line structures, etc.

Transmission lines in radio-frequency transmission line path 50 may be integrated into rigid and/or flexible printed circuit boards. In one suitable arrangement, radio-frequency transmission line path 50 may include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network may include components such as inductors, resistors, and capacitors used in matching the impedance of antenna 40 to the impedance of radio-frequency transmission line path 50. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Radio-frequency transmission line path 50 may be coupled to antenna feed structures associated with antenna 40. As an example, antenna 40 may form an inverted-F antenna, a planar inverted-F antenna, a patch antenna, or other antenna having an antenna feed 44 with a positive antenna feed terminal such as terminal 46 and a ground antenna feed terminal such as ground antenna feed terminal 48. Signal conductor 52 may be coupled to positive antenna feed terminal 46 and ground conductor 54 may be coupled to ground antenna feed terminal 48. Other types of antenna feed arrangements may be used if desired. If desired, switches or filters may be interposed on radio-frequency transmission line path 50 to allow antenna 40 to convey radio-frequency signals using both UWB transceiver circuitry 36 and non-UWB transceiver circuitry 38 of FIG. 1. The illustrative feeding configuration of FIG. 2 is merely illustrative.

Any desired antenna structures may be used for implementing the antennas 40 in device 10. In one suitable arrangement that is sometimes described herein as an example, inverted-F antenna structures may be used for implementing antennas 40. Antennas that are implemented using inverted-F antenna structures may sometimes be referred to herein as inverted-F antennas.

Figure 3:
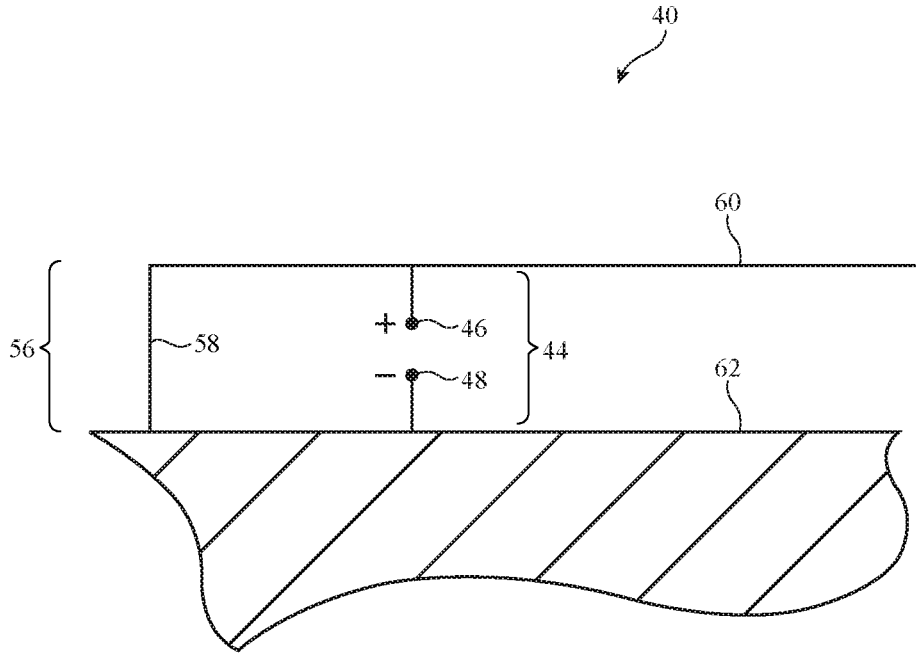
FIG. 3 is a schematic diagram of illustrative inverted-F antenna structures in accordance with some embodiments.

FIG. 3 is a schematic diagram of inverted-F antenna structures that may be used to form a given antenna 40. As shown in FIG. 3, antenna 40 may include an antenna resonating element such as antenna resonating element 56 (sometimes referred to herein as antenna radiating element 56) and an antenna ground such as antenna ground 62. Antenna resonating element 56 may include a resonating element arm 60 (sometimes referred to herein as an antenna resonating element arm or a radiating element arm) that is shorted to antenna ground 62 by return path 58. Antenna 40 may be fed by coupling a transmission line (e.g., a transmission line in radio-frequency transmission line path 50 of FIG. 2) to positive antenna feed terminal 46 and ground antenna feed terminal 48 of antenna feed 44. Positive antenna feed terminal 46 may be coupled to resonating element arm 60 and ground antenna feed terminal 48 may be coupled to antenna ground 62. Return path 58 may be coupled between resonating element arm 60 and antenna ground 62 in parallel with antenna feed 44.

The length of resonating element arm 60 may determine the response (resonant) frequency of the antenna. For example, the length of resonating element arm 60 may be approximately (e.g., within 15% of) one-quarter of a wavelength of operation for antenna 40 (e.g., an effective wavelength that is modified from a free space wavelength by a constant factor determined from the dielectric constant of the material surrounding antenna 40). The effective wavelength may lie within the communications band covered by antenna 40. This length may be associated with the fundamental mode of antenna 40. If desired, one or more harmonic modes of the antenna may also be used to cover one or more additional communications bands. Impedance matching circuitry may be coupled to antenna 40 to further adjust the frequency response of the antenna if desired.

During operation, device 10 may communicate with external wireless equipment such as external equipment 20 of FIG. 1. If desired, external equipment 20 may use UWB signals conveyed from device 10 to external equipment 20 to identify the location of device 10 relative to external equipment 20. External equipment 20 may identify the relative location of device 10 by identifying a range from external equipment 20 and device 10 (e.g., the distance between the external equipment 20 and device 10) and the angle of arrival (AoA) of UWB signals transmitted by device 10 at the location of external equipment 20 (e.g., the angle at which UWB signals transmitted by device 10 are received by external equipment 20).

Figure 4:
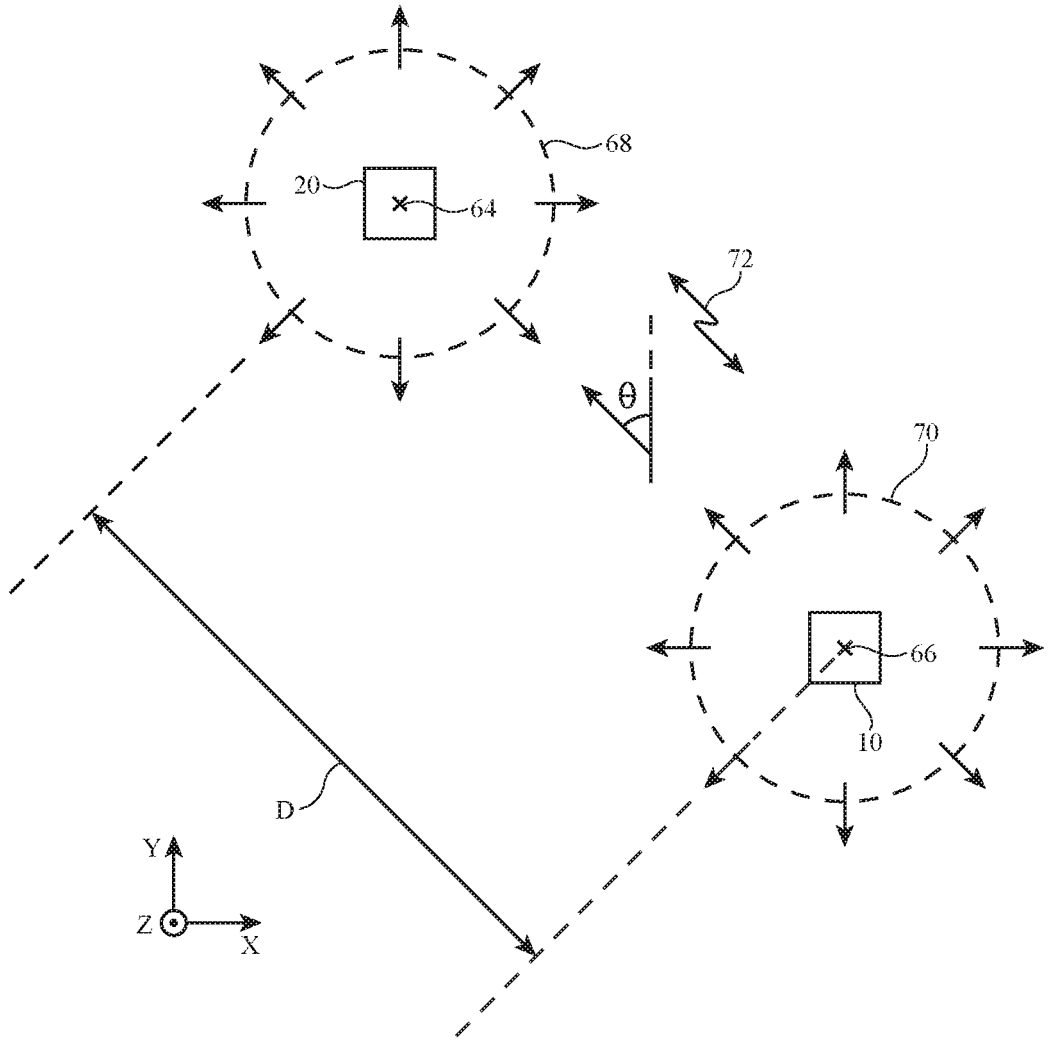
FIG. 4 is a diagram showing how external equipment may identify the location of an illustrative electronic device relative to the external equipment (e.g., range and angle of arrival) in accordance with some embodiments.

FIG. 4 is a diagram showing how external equipment 20 may identify the relative location of device 10. As shown in FIG. 4, device 10 may be located at point 66 whereas external equipment 20 is located at point 64. In one suitable arrangement, antennas on external equipment 20 may transmit UWB signals 68 in one or more UWB communications bands (e.g., in the 6.5 GHz UWB communications band and the 8.0 UWB communications band). External equipment 20 may periodically (e.g., autonomously) transmit UWB signals 68, may transmit UWB signals 68 in response to a command from an application running on external equipment 20, may transmit UWB signals 68 in response to an input from a user of external equipment 20 (e.g., an input command provided by a user to input-output circuitry on external equipment 20 when the user would like to identify the location of device 10), or may identify the location of device 10 without transmitting UWB signals 68. In the example of FIG. 4, UWB signals 68 are transmitted omnidirectionally from external equipment 20. This is merely illustrative. If desired, UWB signals 68 may be transmitted over only a subset of angles in the sphere around external equipment 20.

UWB transceiver circuitry 36 may receive UWB signals 68 from external equipment 20 using one or more antennas 40 (FIGS. 1-3). In response to receiving UWB signals 68 at device 10, control circuitry 28 (FIG. 1) may control UWB transceiver circuitry 36 to transmit UWB signals 70 in one or more UWB communications bands (e.g., in the 6.5 GHz UWB communications band and the 8.0 UWB communications band). In the example of FIG. 4, UWB signals 70 are transmitted omnidirectionally from device 10. This is merely illustrative. If desired, UWB signals 70 may be transmitted over only a subset of angles in the sphere around device 10.

External equipment 20 may receive UWB signals 70 from device 10. Control circuitry on external equipment 20 may determine the range to device 10 (e.g., the distance D between device 10 and external equipment 20) based on the received UWB signals 70. For example, the control circuitry on external equipment 20 may determine distance D using signal strength measurement schemes or using time-based measurement schemes such as time of flight measurement techniques, time difference of arrival measurement techniques, angle of arrival measurement techniques, triangulation methods, time-of-flight methods, using a crowdsourced location database, and other suitable measurement techniques.

In addition to determining the distance D between device 10 and external equipment 20, the control circuitry may determine the orientation of external equipment 20 relative to device 10. For example, external equipment 20 may include multiple antennas that receive UWB signals 70 (e.g., a doublet or triplet of UWB antennas), where each antenna is at a fixed and predetermined location relative to the other antennas. The control circuitry on external equipment 20 may identify phase differences between each antenna for the received UWB signals. The phase differences may be used to determine the angle of arrival θ of UWB signals 70 at external equipment 20 and thus the orientation of device 10 relative to external equipment 20. External equipment 20 may thereby have knowledge of the location of device 10 relative to device 10. In scenarios where external equipment 20 is aware of its own location at point 64, external equipment 20 may also determine the absolute location of device 10 (e.g., at point 66). In the example of FIG. 4, angle of arrival θ is shown only within a single plane (e.g., the X-Y plane of FIG. 4) for the sake of clarity. In general, angle of arrival may be determined within multiple planes (e.g., using spherical coordinates or any other desired three dimensional coordinate scheme).

If desired, external equipment 20 and device 10 may also wirelessly communicate using non-UWB signals 72. Non-UWB signals 72 may be conveyed using any desired non-UWB communications bands such as the 2.4 GHz Bluetooth® communications band. External device 20 may use non-UWB signals 72 to convey data to and/or from external equipment 20.

The example of FIG. 4 is merely illustrative. In another suitable arrangement, external equipment 20 may determine distance D and angle of arrival θ using the received UWB signals 70 without transmitting any UWB signals 68. If desired, device 10 may periodically (e.g., autonomously) transmit UWB signals 70 or may transmit UWB signals 70 in response to any other desired trigger event (e.g., device 10 need not wait for reception of UWB signals 68 to transmit UWB signals 70).

If desired, device 10 may transmit UWB signals 70 in response to receiving a command from external equipment 20 via non-UWB signals 72. For example, when a user of external equipment 20 would like to know the location of device 10, the user may control external equipment 20 to transmit non-UWB signals 72. Non-UWB signals 72 may include control signals that control device 10 to transmit UWB signals 70. Upon receipt of non-UWB signals 72 using non-UWB transceiver circuitry 38 of FIG. 1 (e.g., receipt of the control signals conveyed using non-UWB signals 72), control circuitry 28 may control UWB transceiver 36 to transmit UWB signals 70 to allow external equipment 20 to determine the relative location of device 10 for the user of external equipment 20. If desired, a speaker or other output components on device 10 may issue an audible alert or other sound upon receipt of UWB signals 68 or non-UWB signals 72. This may, for example, help the user of external equipment 20 to physically locate device 10.

Figure 5:
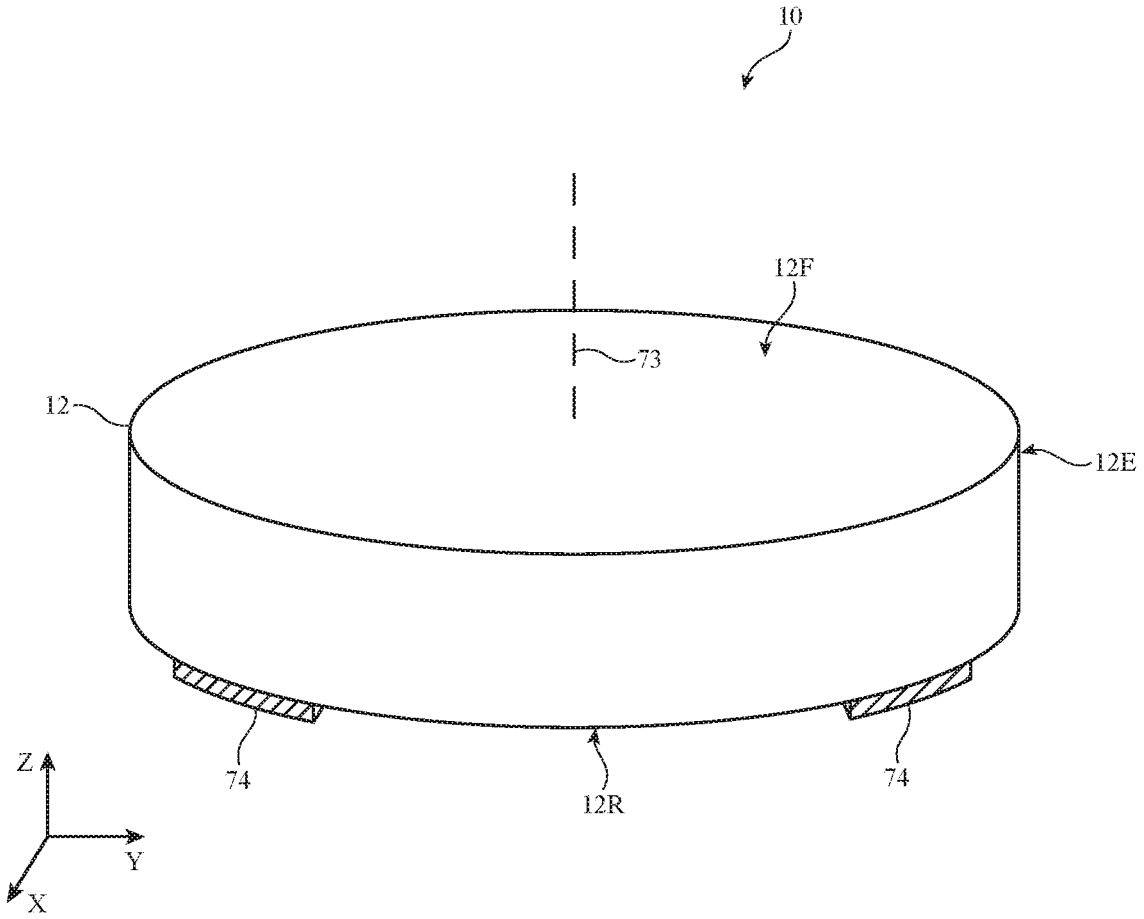
FIG. 5 is a perspective view of an illustrative electronic device in accordance with some embodiments.

FIG. 5 is a perspective view of device 10. As shown in FIG. 5, housing 12 may have a cylindrical shape with sidewall 12E extending circumferentially around central axis 73 (e.g., sidewall 12E may be a continuously curved sidewall or may have any other desired shape following any desired path). Sidewall 12E may extend from rear wall 12R to front wall 12F of housing 12. Sidewall 12E, rear wall 12R, and front wall 12F may be formed from a single integral piece of dielectric and/or metal material (e.g., in a unibody configuration) or may be formed from two or more pieces of dielectric and/or metal materials. In one suitable arrangement, rear wall 12R is flat (e.g., planar) whereas front wall 12F is curved (e.g., dome-shaped, hemispherical, etc.). This is merely illustrative and, in general, front wall 12F and rear wall 12R may have any desired planar or non-planar (e.g., free-form curved) shapes. Front wall 12F need not have the same shape as rear wall 12R. Front wall 12F and rear wall 12R may have lateral outlines that are circular, elliptical, square, rectangular, combinations of these, or any other lateral outlines. Front wall 12F and rear wall 12R may each have a diameter of 0.5-5 cm, 1-6 cm, 1-3 cm, less than 8 cm, less than 5 cm, less than 4 cm, less than 3 cm, or less than 2 cm, as examples. Sidewall 12E may have a height (e.g., parallel to the Z-axis) of 0.1-1 cm, 0.2-0.8 cm, 0.5-2 cm, less than 2 cm, less than 1 cm, or less than 0.5 cm, as examples. Housing 12 need not be cylindrical and may, in general, have any desired shape.

If desired, attachment structures 74 may be provided at or on rear wall 12R. Attachment structures 74 may include adhesive, one or more suction cups, screws, clips, pins, springs, magnets, or any other desired fastening structures. Attachment structures 74 may hold housing 12 in place on an underlying surface or object (not shown in FIG. 5 for the sake of clarity). For example, attachment structures 74 may be used to attach (secure) housing 12 and thus device 10 to another electronic device (e.g., a laptop, tablet, keyboard, mouse, stylus, mobile phone, gaming device, television, headset, headphones, etc.), furniture, keys, other household objects, pets, clothing, etc. When secured to an underlying surface or object in this way, device 10 may help external equipment 20 to identify the location of the underlying surface or object upon receipt of UWB signals 70 (FIG. 4). This example is merely illustrative. Attachment structures 74 may be omitted or formed internally within housing 12 if desired.

The antennas in device 10 may be configured to collectively cover the 2.4 GHz Bluetooth® communications band (or other non-UWB bands) for conveying non-UWB signals 72 of FIG. 4 and first and second UWB communications bands (e.g., the 6.5 GHz UWB communications band and the 8.0 GHz UWB communications band) for conveying UWB signals 70 of FIG. 4. Because these communications bands are relatively far apart in frequency, it can be difficult to cover each of the communications bands with satisfactory antenna efficiency using a single antenna, particularly given the small form factor of housing 12. At the same time, it may be desirable to minimize the number of antennas 40 in device 10 to minimize the size, manufacturing cost, complexity, and power consumption of device 10. In one suitable arrangement, device 10 may include two antennas 40 that collectively cover each of these communications bands with satisfactory antenna efficiency while minimizing size, manufacturing cost, complexity, and power consumption for device 10.

Figure 6:
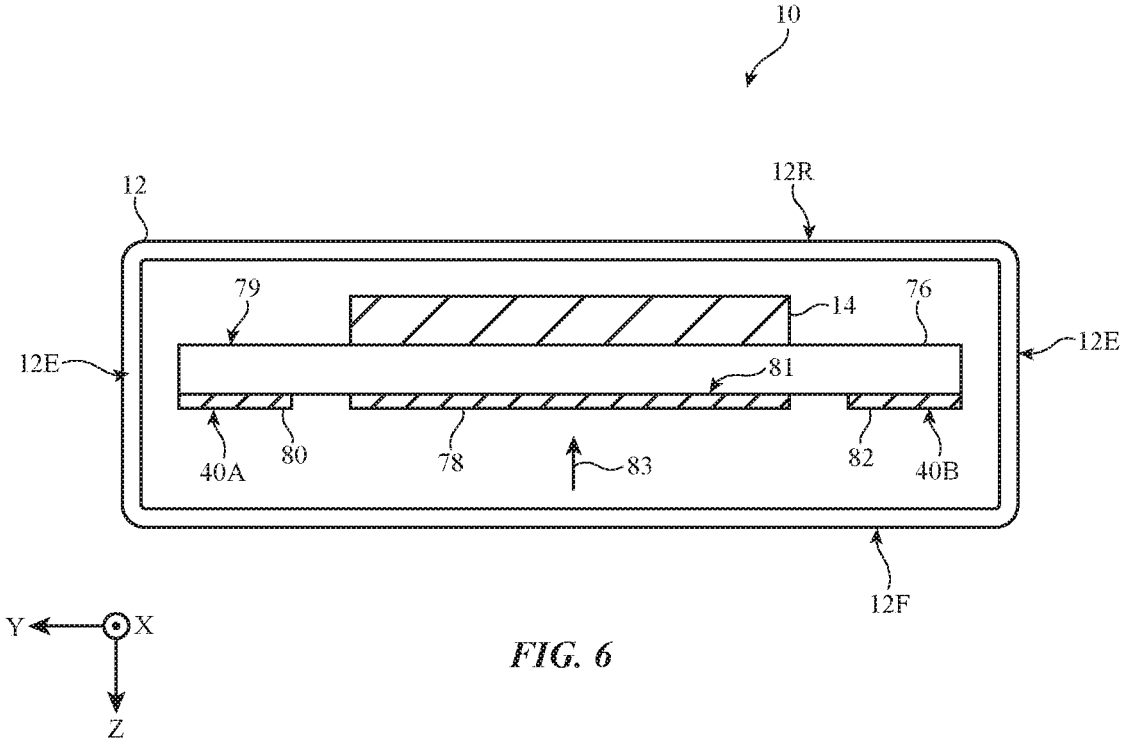
FIG. 6 is a cross-sectional side view of an illustrative electronic device in accordance with some embodiments.

FIG. 6 is a cross-sectional side view of device 10 showing how device 10 may include two antennas 40 for conveying UWB signals 70 and non-UWB signals 72 of FIG. 4. As shown in FIG. 6, device 10 may include a substrate such as logic board 76 (e.g., a main logic board for device 10). Logic board 76 may be a printed circuit board (e.g., a rigid printed circuit board or flexible printed circuit), an integrated circuit package, or any other desired substrate. Battery 14 may be mounted to logic board 76 (e.g., at surface 79). Other components such as control circuitry 28, input/output devices 32, and/or wireless circuitry 34 of FIG. 1 may also be mounted to logic board 76 if desired. Ground traces 78 may be formed on surface 81 of logic board 76. Ground traces 78 may be held at a ground potential (e.g., a system ground potential for device 10).

Device 10 may include two antennas 40 such as a first antenna 40A and a second antenna 40B formed on logic board 76. Antenna 40A may be formed from conductive traces 80 and ground traces 78 on surface 81 of logic board 76. Antenna 40B may be formed from conductive traces 82 and ground traces 78 on surface 81 of logic board 76. Ground traces 78 may form the antenna ground (e.g., antenna ground 62 of FIG. 3) for both antennas 40A and 40B. Conductive traces 80 may form the resonating element arm and return path (e.g., resonating element arm 60 and return path 58 of FIG. 3) for antenna 40A. Conductive traces 82 may form the resonating element arm and return path for antenna 40B. Antennas 40A and 40B may convey radio-frequency signals (e.g., radio-frequency signals 22 of FIG. 1, UWB signals 70 of FIG. 4, and non-UWB signals 72 of FIG. 4) through housing 12. Forming antennas 40A and 40B at opposing sides of logic board 76 (e.g., along the Y-axis) may help to maximize electromagnetic isolation between the antennas.

The example of FIG. 6 is merely illustrative. If desired, antennas 40A and 40B (e.g., conductive traces 80 and 82) may be patterned on surface 79 of logic board 76 instead of surface 81. Battery 14 may be mounted to surface 81 of logic board 76 if desired. Conductive portions of other components in device 10 may form part of the antenna ground for antennas 40A and 40B. In another suitable arrangement, surface 81 of logic board 76 may face rear housing wall 12R and surface 79 of logic board 76 may face front housing wall 12F. Attachment structures 74 of FIG. 5 have been omitted from FIG. 6 for the sake of clarity. Housing 12 may have other shapes if desired.

Figure 7:
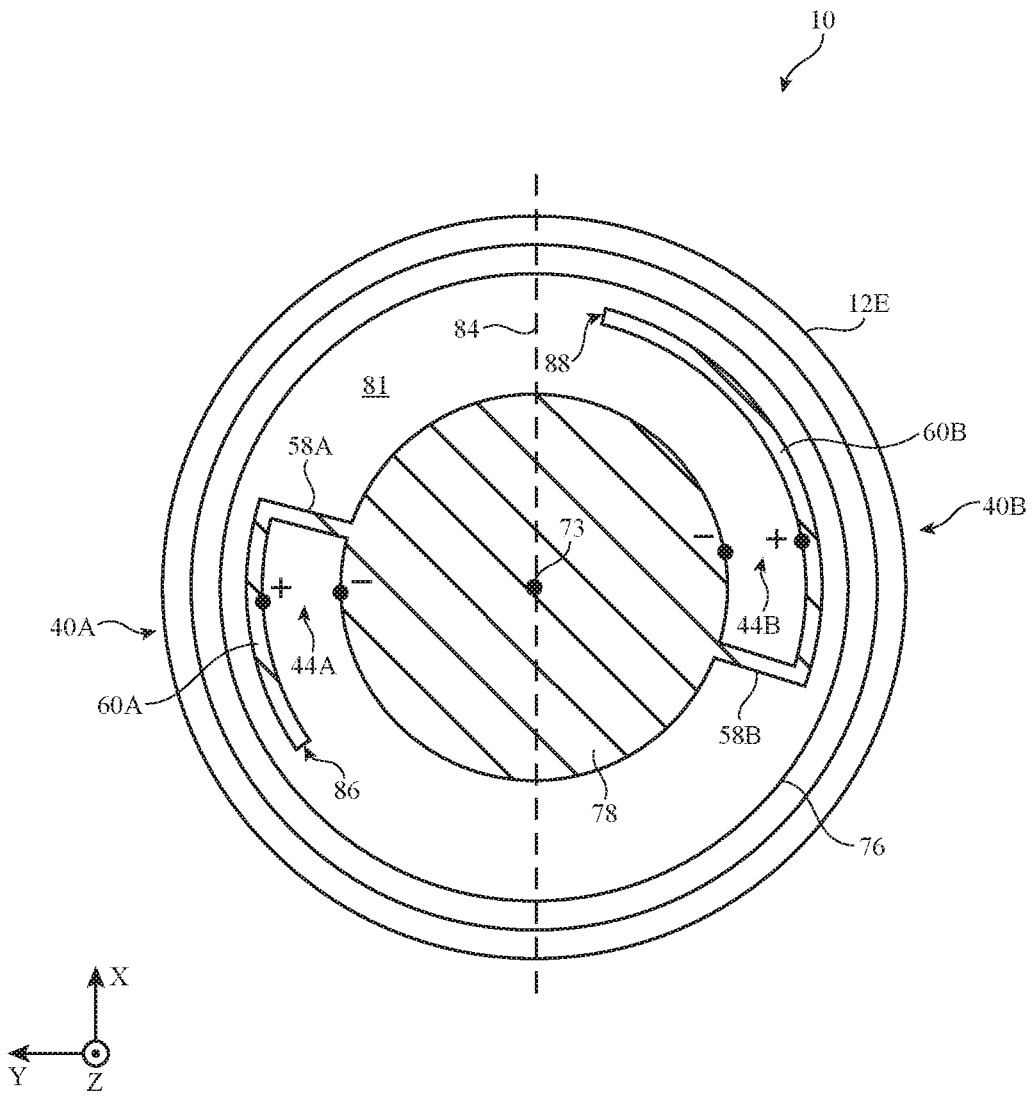
FIG. 7 is a cross-sectional bottom view of an illustrative electronic device in accordance with some embodiments.

FIG. 7 is a cross sectional bottom view of logic board 76 in device 10 (e.g., as taken in the direction of arrow 83 of FIG. 6). As shown in FIG. 7, logic board 76 may have a circular lateral footprint about central axis 73 that conforms to the (cylindrical) shape of sidewall 12E (e.g., the vertical edges of logic board 76 may extend parallel to the vertical surface of sidewall 12E around central axis 73). Ground traces 78 may be patterned onto surface 81 of logic board 76. In the example of FIG. 7, ground traces 78 are radially symmetric about central axis 73 and have a shape that conforms to the lateral footprint of logic board 76. This is merely illustrative and, if desired, ground traces 78 may have any desired shape.

Logic board 76 may have a laterally bisecting axis 84 that extends perpendicular to central axis 73 and runs through the center of device 10. Antenna 40A may be formed at a first side of ground traces 78 and logic board 76 (e.g., to the left of laterally bisecting axis 84). Antenna 40B may be formed at a second side of ground traces 78 and logic board 76 that is opposite to the first side (e.g., to the right of laterally bisecting axis 84). Antennas 40A and 40B may each include a corresponding resonating element arm (e.g., resonating element arm 60 of FIG. 3), return path (e.g., return path 58 of FIG. 3), and antenna feed (e.g., antenna feed 44 of FIG. 3). For example, antenna 40A may have resonating element arm 60A and a return path 58A that couples resonating element arm 60A to ground traces 78. Similarly, antenna 40B may have resonating element arm 60B and a return path 58B that couples resonating element arm 60B to ground traces 78. Antenna feed 44A may have a positive antenna feed terminal (e.g., positive antenna feed terminal 46 of FIG. 3) coupled to resonating element arm 60A and a ground antenna feed terminal (e.g., ground antenna feed terminal 48 of FIG. 3) coupled to ground traces 78. Antenna feed 44B may have a positive antenna feed terminal coupled to resonating element arm 60B and a ground antenna feed terminal coupled to ground traces 78.

Resonating element arm 60A and return path 58A may be formed from conductive traces 80 of FIG. 6 whereas resonating element arm 60B and return path 58B may be formed from conductive traces 82 of FIG. 6. In one suitable arrangement, resonating element arm 60A, return path 58A, resonating element arm 60B, return path 58B, and ground traces 78 are formed from integral portions of the same conductive traces patterned onto surface 81 (e.g., during the same patterning process). In another suitable arrangement, resonating element arm 60A, resonating element arm 60B, return path 58A, and return path 58B may be formed from conductive traces that are patterned onto surface 81 separately from ground traces 78. In this scenario, solder, welds, or other conductive interconnect structures may be used to short return paths 58A and 58B to ground traces 78.

As shown in FIG. 7, resonating element arm 60B may extend from return path 58B to an opposing tip 88. Resonating element arm 60A may extend from return path 58A to an opposing tip 86. Tip 88 may face return path 58A of antenna 40A and tip 86 may face return path 58B of antenna 40B (e.g., resonating element arms 60A and 60B may be oriented in the same rotational direction around central axis 73). This may allow the region of antenna 40A with the highest electric field magnitude (e.g., tip 86) to be located as far away from the region of antenna 40B with the highest electric field magnitude (e.g., tip 88), thereby serving to maximize electromagnetic isolation between antennas 40A and 40B. In the example of FIG. 7, resonating element arms 60A and 60B follow curved paths around central axis 73 that conform to the curved edges of logic board 76 and sidewall 12E. This is merely illustrative and, in general, resonating element arms 60A and 60B may follow any desired path having any desired shape (e.g., any desired shape having curved and/or straight edges). Antennas 40A and 40B need not be inverted-F antennas and may, in general, be formed using any desired antenna structures (e.g., antennas 40A and 40B may be monopole antennas, dipole antennas, loop antennas, etc.).

Resonating element arm 60B may be longer than resonating element arm 60A. This may allow antenna 40B to cover lower frequencies than antenna 40A. Antennas 40A and 40B may collectively cover first, second, and third communications bands such as the 2.4 GHz Bluetooth® communications band, the 6.5 GHz UWB communications band, and the 8.0 GHz UWB communications band. This may allow antennas 40A and 40B to collectively convey both UWB signals 70 and non-UWB signals 72 of FIG. 4, for example.

Figure 8:
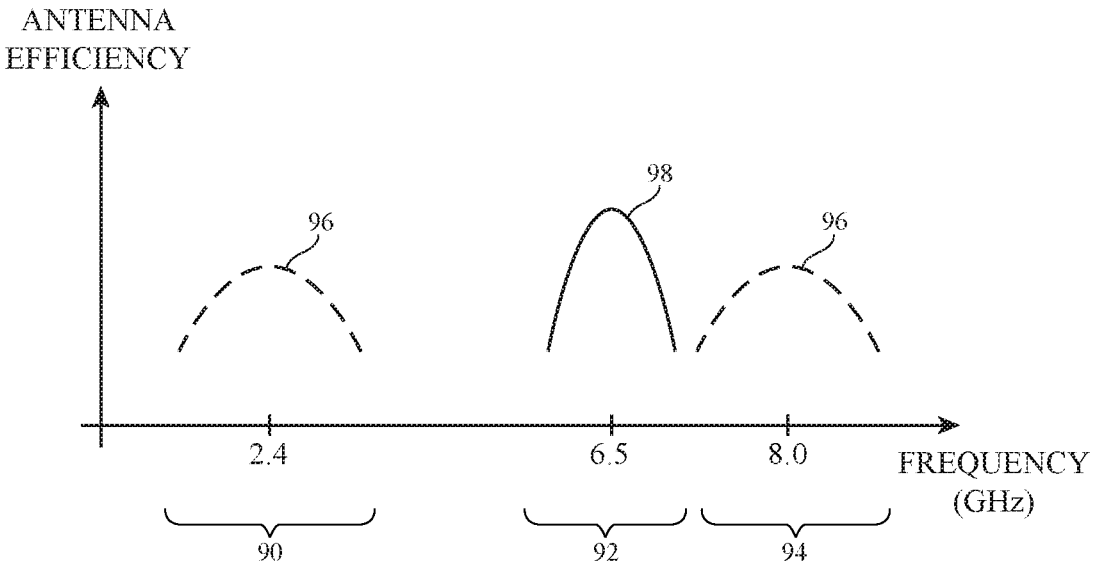
FIGS. 8 and 9 are plots of antenna performance (antenna efficiency) for antennas of the types shown in FIGS. 1-7 in accordance with some embodiments.

FIG. 8 is a plot of antenna efficiency as a function of frequency that illustrates one example of how antennas 40A and 40B may cover each of these communications bands. As shown in FIG. 8, solid curve 98 illustrates the frequency response of antenna 40A of FIG. 7 whereas dashed curve 96 illustrates the frequency response of antenna 40B of FIG. 7.

As shown by dashed curve 96, the length of resonating element arm 60B may be selected to configure antenna 40B to exhibit a response peak in a first communications band such as communications band 90 (e.g., the 2.4 GHz Bluetooth® communications band). This response peak may be produced by the fundamental mode of resonating element arm 60B. At the same time, a harmonic mode of resonating element arm 60B (e.g., the third order harmonic of resonating element arm 60B) may produce a response peak in a third communications band such as communications band 94 (e.g., the 8.0 GHz UWB communications band).

As shown by curve 98, the length of resonating element arm 60A may be selected to configure antenna 40A to exhibit a response peak in a second communications band such as communications band 92 (e.g., the 6.5 GHz UWB communications band). In this way, antenna 40A and antenna 40B may collectively cover each of communications bands 90, 92, and 94 with satisfactory antenna efficiency.

Figure 9:
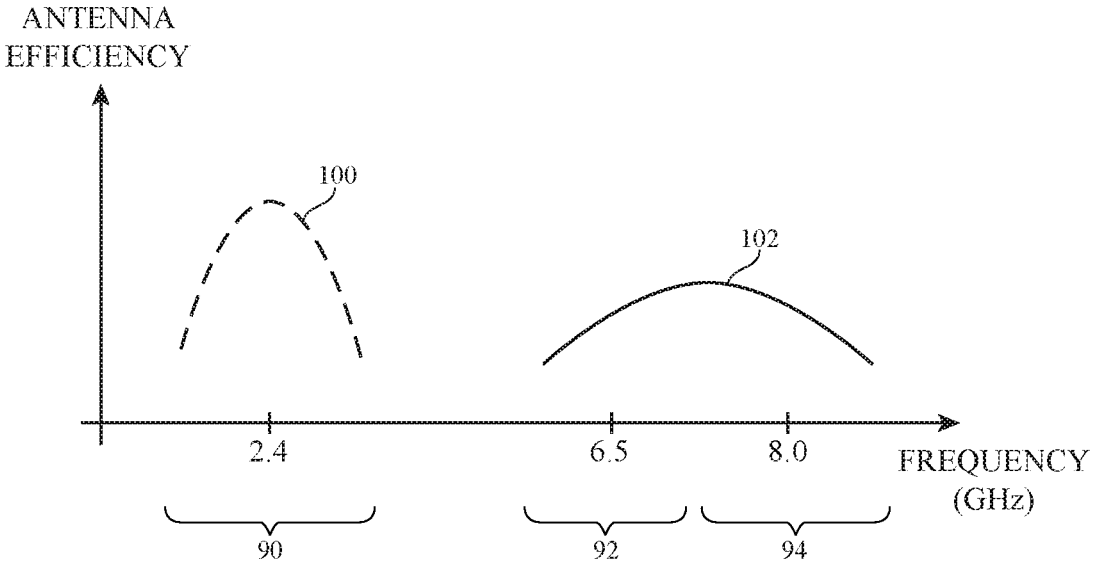

FIG. 9 is a plot of antenna efficiency as a function of frequency that illustrates how antennas 40A and 40B may cover each of these communications bands in another suitable arrangement. As shown in FIG. 9, solid curve 102 illustrates the frequency response of antenna 40A of FIG. 7 whereas dashed curve 100 illustrates the frequency response of antenna 40B of FIG. 7.

As shown by curve 100, the length of resonating element arm 60B may be selected to configure antenna 40B to exhibit a response peak in first communications band 90. This response peak may be produced by the fundamental mode of resonating element arm 60B. Harmonic modes of resonating element arm 60B need not be used in this arrangement.

As shown by curve 102, the length of resonating element arm 60A may be selected to configure antenna 40A to exhibit a response peak at a frequency between communications bands 92 and 94 (e.g., at a frequency between 6.5 GHz and 8.0 GHz). Antenna 40A may have a sufficiently large bandwidth such that this response peak causes antenna 40A to exhibit satisfactory antenna efficiency (e.g., an antenna efficiency greater than a threshold efficiency) across both of communications bands 92 and 94. In this way, antenna 40A and antenna 40B may collectively cover each of communications bands 90, 92, and 94 with satisfactory antenna efficiency.

The examples of FIGS. 8 and 9 are merely illustrative. In general, curves 96, 98, 100, and 102 may have any desired shapes and may cover any desired frequencies. Communications band 90 may be any desired non-UWB communications band. Communications bands 92 and 94 may be any desired UWB communications bands.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:
a housing;
a logic board in the housing;
ground traces on a surface of the logic board;
a first antenna having a first resonating element arm and a first antenna feed, wherein the first resonating element arm is formed from first conductive traces on the surface of the logic board, the first antenna feed being coupled between the first resonating element arm and the ground traces; and
a second antenna having a second resonating element arm and a second antenna feed, wherein the second resonating element arm is formed from second conductive traces on the surface of the logic board, the second antenna feed is coupled between the second resonating element arm and the ground traces, the first antenna is configured to radiate in an ultra-wideband communications band, and the second antenna is configured to radiate in a non-ultra-wideband communications band.

2. The electronic device defined in claim 1, wherein the first resonating element arm comprises a first inverted-F antenna resonating element arm and the second resonating element arm comprises a second inverted-F antenna resonating element arm.

3. The electronic device defined in claim 2, wherein the first conductive traces comprise a first return path that shorts the first inverted-F antenna resonating element arm to the ground traces, the second conductive traces comprise a second return path that shorts the second inverted-F antenna resonating element arm to the ground traces, wherein the first inverted-F antenna resonating element arm has a first tip that faces the second return path, and the second inverted-F antenna resonating element arm has a second tip that faces the first return path.

4. The electronic device defined in claim 3, wherein the first and second inverted-F antenna resonating element arms are formed on opposing sides of the ground traces.

5. The electronic device defined in claim 4, wherein the first and second inverted-F antenna resonating element arms are curved.

6. The electronic device defined in claim 5, wherein the housing comprises a front wall, a rear wall, and a cylindrical sidewall extending from the rear wall to the front wall.

7. The electronic device defined in claim 6, wherein the logic board has a lateral outline with a shape that conforms to the cylindrical sidewall, the first and second inverted-F antenna resonating element arms extending parallel to a surface of the cylindrical sidewall.

8. The electronic device defined in claim 6, further comprising attachment structures configured to secure the rear wall to an external object.

9. The electronic device defined in claim 1, wherein the non-ultra-wideband communications band comprises a Bluetooth® communications band and the ultra-wideband communications band comprises a frequency greater than 5.0 GHz.

10. The electronic device defined in claim 9, wherein the first antenna is further configured to radiate in an additional ultra-wideband communications band that comprises frequencies greater than the ultra-wideband communications band.

11. The electronic device defined in claim 10, wherein the first antenna resonating element arm has a fundamental mode that radiates in the Bluetooth® communications band and a third order harmonic mode that radiates in the additional ultra-wideband communications band.

12. The electronic device defined in claim 11, further comprising:

a Bluetooth® transceiver mounted to the logic board and coupled to the first antenna; and an ultra-wideband transceiver mounted to the logic board and coupled to the first and second antennas.

13. The electronic device defined in claim 12, wherein the ultra-wideband communications band comprises 6.5 GHz and the additional ultra-wideband communications band comprises 8.0 GHz.

14. The electronic device defined in claim 9, wherein the second antenna is further configured to radiate in an additional ultra-wideband communications band that comprises frequencies greater than the ultra-wideband communications band.

15. The electronic device defined in claim 14, further comprising:

a Bluetooth® transceiver mounted to the logic board and coupled to the first antenna; and an ultra-wideband transceiver mounted to the logic board and coupled to the second antenna, wherein the ultra-wideband communications band comprises 6.5 GHz and the additional ultra-wideband communications band comprises 8.0 GHz.

16. An electronic device comprising:

a housing having a rear wall, a front wall, and a sidewall extending from the rear wall to the front wall about a central axis of the electronic device;

a printed circuit board in the housing, the printed circuit board being configured to receive a battery that powers the electronic device;

ground traces on a surface of the printed circuit board;

a first inverted-F antenna that includes the ground traces and a first resonating element arm formed from first conductive traces on the surface of the printed circuit board, wherein the first resonating element arm has a fundamental mode that radiates in a communications band that includes 2.4 GHz, the first resonating element arm having a harmonic mode that radiates in a first ultra-wideband communications band; and a second inverted-F antenna that includes the ground traces and a second resonating element arm formed from second conductive traces on the surface of the printed circuit board, the second resonating element arm being configured to radiate in a second ultra-wideband communications band that is lower in frequency than the first ultra-wideband communications band.

17. The electronic device defined in claim 16, wherein the first and second resonating element arms are located at opposing sides of the ground traces and extend in the same direction about the central axis of the electronic device, the first ultra-wideband communications band comprises 8.0 GHz, and the second ultra-wideband communications band comprises 6.5 GHz.

18. An electronic device, comprising:

a housing having a rear wall, a front wall opposite the rear wall, and a cylindrical sidewall that extends from the rear wall to the front wall about an axis;

a logic board in the housing and having a surface, wherein the logic board has a lateral outline that conforms to the cylindrical sidewall;

ground traces on the surface;

a first inverted-F antenna resonating element arm formed from first conductive traces on the surface; and a second inverted-F antenna resonating element arm formed from second conductive traces on the surface, wherein the first and second inverted-F antenna resonating element arms are curved about the axis, the first inverted-F antenna is configured to radiate in a 2.4 GHz communications band, and the second inverted-F antenna is configured to radiate in a first ultra-wideband communications band that comprises 6.5 GHz and a second ultra-wideband communications band that comprises 8.0 GHz.

19. The electronic device defined in claim 18, further comprising:

a first return path that couples the first inverted-F antenna resonating element arm to the ground traces, wherein the first inverted-F antenna resonating element arm has a first tip opposite the first return path; and a second return path that couples the second inverted-F antenna resonating element arm to the ground traces, wherein the second inverted-F antenna resonating element arm has a second tip opposite the second return path, the first tip faces the second return path about the axis, and the second tip faces the first return path about the axis.

20. The electronic device defined in claim 18, wherein the cylindrical sidewall has a diameter that is less than 8 cm, the cylindrical sidewall has a height that is less than 2 cm, and the electronic device does not have any display pixel circuitry.

* * * * *